US006915558B2

(12) United States Patent
Jin et al.

(10) Patent No.: US 6,915,558 B2
(45) Date of Patent: Jul. 12, 2005

(54) METHOD OF ASSEMBLING SEPARABLE TRANSFORMER

(75) Inventors: Dongzhi Jin, Chiba (JP); Fumihiko Abe, Chiba (JP); Hajime Mochizuki, Tokorozawa (JP); Yasunori Habiro, Yokohama (JP); Masahiro Hasegawa, Kameyama (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 165 days.

(21) Appl. No.: 10/213,169

(22) Filed: Aug. 6, 2002

(65) Prior Publication Data

US 2002/0184751 A1 Dec. 12, 2002

Related U.S. Application Data

(62) Division of application No. 09/485,372.

(30) Foreign Application Priority Data

Jun. 10, 1998 (JP) ..... 10-162555
Jun. 10, 1998 (JP) ..... 10-162557
Jun. 10, 1998 (JP) ..... 10-162558

(51) Int. Cl.[7] ..... H01F 7/06

(52) U.S. Cl. ..... 29/602.1; 29/469; 29/564.5; 29/596; 29/598; 29/605; 29/606; 29/607; 360/108; 360/281.2; 360/281.3; 360/281.4

(58) Field of Search ..... 29/469, 564.5, 29/596, 598, 602.1, 605–607; 360/108, 281.2, 281.3, 281.4

(56) References Cited

U.S. PATENT DOCUMENTS 3,762,042 A * 10/1973 Abe et al. ..... 29/598
3,968,559 A 7/1976 Karlsson
4,038,624 A 7/1977 Namba et al.
4,339,873 A * 7/1982 Kanamaru et al. ..... 29/598

(Continued)

FOREIGN PATENT DOCUMENTS

| | | | | |
|---|---|---|---|---|
| EP | 0 336 422 A2 | | 10/1989 | |
| JP | 55-52210 A | | 4/1980 | |
| JP | 59-08308 A | | 1/1984 | |
| JP | 59-46012 A | | 3/1984 | |
| JP | 63-13309 A | | 1/1988 | |
| JP | 01170352 A | * | 7/1989 | ..... H02K/19/24 |
| JP | 3-297109 A | | 12/1991 | |
| JP | 6-36939 A | | 2/1994 | |

OTHER PUBLICATIONS

"Method of magnetic sources applied to the basic configuration of a rotating electrical machine"; Stoll, R.L.; Bodner, B.; Al– Khoury, A.H.N.; Electrical Power Applications, IEE Proceedings B, vol.: 140, Issue: 3 , May 1993; pp.:217–231.*

*Primary Examiner*—Paul D Kim
(74) *Attorney, Agent, or Firm*—Frishauf, Holtz, Goodman & Chick, P.C.

(57) ABSTRACT

A stator core (11) is mounted to a stationary member (22) and electric wiring on the stator side is carried out, to thereby assemble a first sub-module (20), and a rotor core (12) is mounted to a rotary member (21) and electric wiring on the rotor side is carried out, to thereby assemble a second sub-module (30). Thereafter, the first and second sub-modules are assembled together, with the stator core and the rotor core opposed to each other, whereby a separable transformer is assembled. A guide member (27), having first and second reference faces defining reference positions in diametrical and axial directions of the rotation shaft (21), respectively, is provided in the rotation shaft (21) rotatably supported by the stationary member and mounted with the rotor core. Mounting positions of the cores are determined with use of the guide member, thereby precisely setting a center position between the cores and a gap length g.

3 Claims, 6 Drawing Sheets

U.S. PATENT DOCUMENTS 4,611,749 A 9/1986 Kawano
5,126,906 A 6/1992 Ohji et al.
5,363,263 A 11/1994 Ohji et al.
5,519,275 A 5/1996 Scott et al.
5,574,216 A 11/1996 Hiyama
5,587,859 A * 12/1996 Nagatsuka ..... 360/281.4
5,694,273 A 12/1997 Takeuchi
5,737,154 A 4/1998 Kumagai et al.
5,739,986 A 4/1998 Van Vlerken et al.
5,798,894 A 8/1998 Takeuchi
5,841,208 A 11/1998 Abe
5,894,653 A * 4/1999 Nakamura et al. ..... 29/596
6,148,245 A 11/2000 Lynch et al.
6,243,240 B1 6/2001 Ozue et al.
6,314,630 B1 11/2001 Munk et al.

* cited by examiner

METHOD OF ASSEMBLING SEPARABLE TRANSFORMER

This is a Division of application Ser. No. 09/485,372 filed Feb. 8, 2000, now abandoned, which is a 371 of PCT/JP99/03103 filed Jun. 10, 1999.

TECHNICAL FIELD

The present invention relates to a method of easily and precisely assembling a separable transformer, including primary and secondary cores disposed opposite to each other and adapted to carry out contactless signal/energy transmission between the cores, e.g., a rotary-type separable transformer (rotary transformer) having primary and secondary cores one of which is mounted to a rotary member. More particularly, the present invention relates to a separable-transformer assembling method which is capable of performing electric wiring for primary and secondary cores with ease and of sufficiently improving the assembling accuracy in respect of a gap length defined between the cores.

BACKGROUND ART

A separable transformer, including primary and secondary cores disposed opposite to each other, has a function of transmitting signal or energy between the cores in a contactless fashion by means of electromagnetic coupling. Especially, a rotary-type separable transformer, called a rotary transformer, including a stator core and a rotor core (primary and secondary cores) respectively mounted to a stationary member and a rotary member rotatably supported by the stationary member, is widely used in various applications. In general, a separable transformer (rotary transformer) of this type is provided in the form of a one-piece module that is comprised of primary and secondary cores (stator and rotor cores) assembled in advance into one piece, with these cores disposed opposite to each other. For instance, the modularized separable transformer (rotary transformer) is incorporated into an automotive steering unit and serves to transmit explosive energy of an air bag apparatus mounted to a steering unit or transmit a signal to a cruise control unit.

The assemblage of an automotive steering unit is generally performed in a final assembling stage in a main assembly line where an instrument panel, a console box, a seat and the like are mounted to a vehicle body. Thus, a space available for the assemblage of a steering unit is largely limited. Under such circumstances, an operator is obliged to keep a hard posture during the operation of mounting a separable transformer to a steering unit and electrically connecting primary- and secondary-side component parts of the separable transformer individually to electric circuits of a shaft module (stationary member) and a steering wheel module (rotary member).

In the case of a separable transformer comprised of primary and secondary-side component parts that can be assembled in advance separately from each other, it is conceivable that the assemblage of the separable transformer may be made at the same time when the separable transformer (rotary transformer) is mounted to a steering unit. In this case, however, the separately assembled primary- and secondary-side component parts must be incorporated into the steering unit with a considerably high degree of assembling precision. Further, it is very difficult to precisely align axes of both the primary and secondary cores (stator and rotor cores) of the separable transformer (rotary transformer) with each other and to set the distance (gap length) between the opposed cores with high accuracy so as to permit the separable transformer to exhibit intended capabilities.

The present invention has been accomplished in view of the above circumstances, and it is an object of the present invention to provide a method capable of assembling a separable transformer with improved workability.

Especially, an object of the present invention is to provide a method of assembling a separable transformer, which makes it easy to carry out electric wiring operations for primary- and secondary-side component parts of the separable transformer.

Another object of the present invention is to provide a method of assembling a separable transformer, which is capable of precisely setting a positional relationship between a primary core and a secondary core by a simple operation procedure.

DISCLOSURE OF THE INVENTION

To achieve the above objects, the present invention provides a method of easily assembling a separable transformer, which comprises a step of assembling a primary sub-module by mounting a primary core of the separable transformer to a primary unit and by carrying out electric wiring, and a step of assembling a secondary sub-module by mounting a secondary core of the separable transformer to a secondary unit and by carrying out electric wiring, and a step of assembling the primary sub-module and the secondary sub-module together, with the primary core and the secondary core disposed opposite to each other.

In a case where the separable transformer is comprised of a rotary transformer including a stator core mounted to a stationary member and a rotor core mounted to a rotary member, the present invention is achieved by separately assembling the primary sub-module and the secondary sub-module into a stator side sub-module and a rotor side sub-module, respectively, and by assembling these sub-modules together, thereby assembling the rotary transformer. Thus, a separable-transformer assembling method is provided, which can facilitate an operation of assembling a separable transformer even if a rotary transformer is mounted to a steering unit.

In a case where the primary core comprises a stator core adapted to be mounted to a stationary member and the secondary core comprises a rotor core adapted to be mounted to a rotation shaft that is rotatably supported by the stationary member, a separable-transformer assembling method of the present invention is achieved by providing the rotation shaft with a guide member having a first reference face defining a reference position in a diametrical direction of the rotation shaft and a second reference face defining a reference position in an axial direction of the rotation shaft, and by mounting the stator core and the rotor core individually to the stationary member and the rotation shaft with reference to the first and second reference faces of the guide member. By mounting the stator core and the rotor core with reference to the reference faces of the guide member, the positional relation between the cores is set precisely only by a simple operation.

Preferably, the stator core is positioned with respect to the rotation shaft through a jig, mounted to the guide member, and is mounted to the stationary member. Further, the rotor core is relatively movably mounted to the rotary member and temporarily held by the rotation shaft, and the rotor core, abutting against the guide member, is positioned with respect to the rotation shaft and fixed to the rotation shaft together with the rotary member.

In a case where the primary core comprises a stator core adapted to be mounted to a stationary member and the secondary core comprises a rotor core adapted to be mounted to a rotation shaft that is rotatably supported by the stationary member, a separable-transformer assembling method of the present invention is achieved by mounting the stator core and the rotor core individually to the stationary member and the rotation shaft with reference to those reference portions on the stationary-member side which define a rotation center and a mounting position of the rotation shaft, or with reference to auxiliary reference portions defined in advance with reference to the reference portions. More specifically, the present invention is characterized in that the cores are mounted with reference to the rotation shaft, or the bearing mechanism which rotatably supports the rotation shaft, or a reference face of a bracket whose position is precisely adjusted in advance with respect to the bearing mechanism.

BEST MODE FOR CARRYING OUT THE INVENTION

With reference to the drawings, separable-transformer assembling methods according to embodiments of the present invention will be explained while taking, as an example, a rotary transformer adapted to be mounted to an automotive steering unit.

[First Embodiment]

Figure 1:
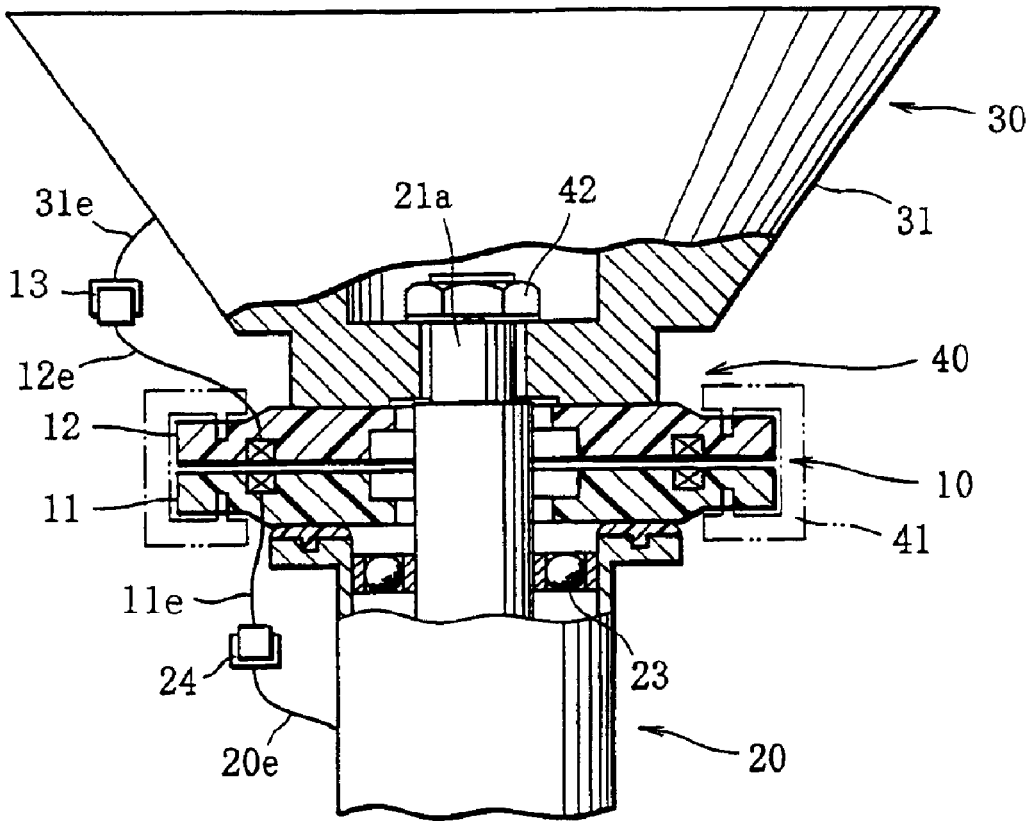
FIG. 1 is a sectional view, showing a first embodiment of the present invention, for explaining a structure and an assembling procedure of a steering module including a rotary transformer.

As shown in FIG. 1, a rotary transformer (separable transformer) 10 includes a primary core (stator core) 11 provided on the side of a shaft module 20 of an automobile and a secondary core (rotor core) 12 provided on the side of a steering wheel module 30 that is mounted to the shaft module 20 and serves as a rotary member. The cores 11 and 12 are coaxially disposed so as to be opposed to and out of contact with each other at a predetermined distance. For instance, the rotary transformer 10 serves to make contactless transmission of electric energy between the primary core 11 and the secondary core 12, the electric energy being supplied from a battery (not shown) on the side of the stationary member to initiate the inflation of an air bag apparatus (not shown) incorporated on the side of the steering wheel module 30.

Figure 2:
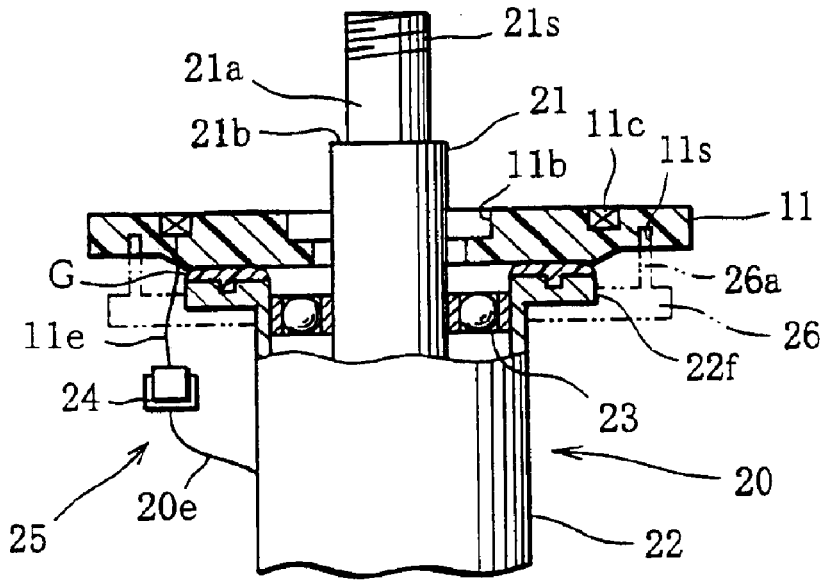
FIG. 2 is a sectional view for explaining a structure and an assembling procedure of a shaft module shown in FIG. 1.
Figure 3:
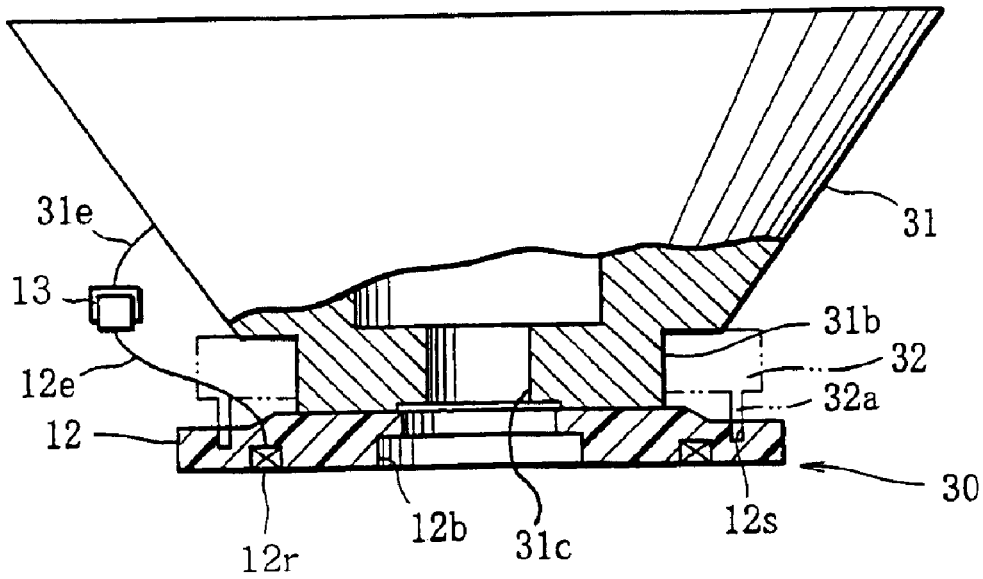
FIG. 3 is a sectional view for explaining a structure and an assembling procedure of a steering wheel module shown in FIG. 1.

The shaft module 20 including the primary core 11 is assembled in advance as shown in FIG. 2 in a sub-assembly line (shaft-module assembly line) of an automotive assembly line. The steering wheel module 30 including the secondary core 12 is assembled as shown in FIG. 3 in another sub-assembly line (steering-wheel-module assembly line) of the automotive assembly line. Thereafter, these sub-modules 20 and 30 are supplied to a main assembly line (vehicle assembly line) in the automotive assembly line, and are assembled into the form of a steering wheel module 40 including the separable transformer 10 as shown in FIG. 1.

More specifically, as shown in FIG. 2, the shaft module (primary-side module) 20 is assembled into a primary sub-module by mounting the primary core 11 of the separable transformer 10 to a primary-side unit 25 comprising a steering shaft 21, a column shaft 22 and the like.

That is, the primary-side unit 25 is assembled such that the steering shaft 21 is rotatably supported by the cylindrical column shaft 22 and that one end portion of the steering shaft 21 longitudinally projects beyond an end face of the column shaft 22. The assembled primary-side unit 25 is supplied to the sub-assembly line. An end portion 21*a* of the steering shaft 21, projecting beyond the end face of the column shaft 22, is formed to have such a small diameter as to permit a boss 31*b* of a steering wheel 31, described later, to be fixedly fitted thereon in a state that it abuts against a stepped portion 21*b* of the steering shaft, which determines the mounting position of the boss 31*b*. The end portion 21*a* of the steering shaft has a tip end section thereof formed with a threaded groove 21*s* with which the steering wheel boss 31*b* is fixed. As will be described later, the stepped portion 21*a* serves to determine a distance (gap length) between the opposed primary and secondary cores 11 and 12 when the shaft module 20 and the steering wheel module 30 are assembled together.

The column shaft 22 is formed at one end portion with an annular flange 22*f* on which the primary core 11 of the rotary transformer 10 is mounted. The primary core 11 constituting the rotary transformer 10 is adhered and fixed to an upper face of the flange 22*f* using an adhesive G made of two-part mixture type epoxy resin.

The primary core 11 comprises a flat plate-like ring of a predetermined thickness made of mixed soft magnetic material including insulative material, having electrical insulating properties, and soft magnetic material. A ring-like primary coil 11*c* is embedded in one end face of the primary core 11 coaxially therewith. The one end face is formed into a flat coupling face for electromagnetic coupling between itself and the secondary core 12. A circular hole 11*b* formed in a central portion of the primary core 11 has such a size as to permit the steering wheel shaft 21 to pass therethrough. The primary core 11 is formed at another end face with a ring-like groove 11*s* for positioning the primary core 11.

To mount the primary core 11 to the primary-side unit 25, adhesive G is first applied to the upper face of the flange 22*f* of the column shaft 22. A positioning jig 26 is attached to the flange 22*f*, while taking a lower face and an outer peripheral face of the flange 22 *f* as the reference. With another end face, formed with the groove 11*s*, of the primary core 11 directed downward, the primary core 11 is mounted to the flange 22*f* from above, while permitting the steering shaft 21 to pass through the circular hole 11*b* formed therein, so that the primary core 11 is superposed on the flange 22*f*. At this time, a claw 26*a* of the positioning jig 26 is fitted into the groove 11*s*, whereby the primary core 11 is positioned coaxially with the flange 22*f* (column shaft 22) at an accurate vertical position. This state is kept until the adhesive G is cured. As a result, the primary core 11 is precisely fixed at a predetermined mounting position relative to the flange 22*f* (column shaft 22) and relative to the steering shaft 21 which is rotatably supported by the column shaft 22 through a bearing mechanism 23.

After the primary core 11 and the primary-side unit 25 are assembled (joined) together in this manner, the positioning jig 26 is removed. Subsequently, an electric wire 11*e* pulled out from the primary coil 11*c* of the primary core 11 is electrically connected with an electric wire 20*e* that is connected to the battery of the shaft module 20. For this electrical connection, a pair of connectors 24 are employed, for example. The operation of electric connection (wiring) can be done in an easy posture in the sub-assembly line, so that the operation efficiency may improve. Since no substantial restrictions are imposed in operation environment, it is possible to connect the electric wires 11*e* and 20*e* together by means of a connecting method which is inexpensive and of high reliability, such as ultrasonic welding, resistance welding, pressure welding, soldering or the like, instead of making the electrical connecting operation using the connectors 24.

With the above-described assembling operation, the primary core 11 is mounted to the end face of the column shaft 22 on the side of the primary unit 25, thereby completing the assemblage of the shaft module (primary module) 20 for which electric wiring has been made. If the primary core 11 can be fixed precisely and rigidly to the end face of the column shaft 22, it is not inevitably necessary to provide the flange 22*f* in the column shaft 22.

On the other hand, the steering wheel module 30 is assembled by mounting the secondary core 12 of the separable transformer 10 to the boss 31*b* of the steering wheel 31 as shown in FIG. 3. The boss 31*b* is provided with a mounting hole 31*c* into which an end portion 21*a* of the steering shaft 21 can be inserted. The air bag apparatus (not shown) is incorporated in advance into the steering wheel 31.

Like the above-described primary core 11, the secondary core 12 mounted to the boss 31*b* comprises a flat plate-like ring having a predetermined thickness made of mixed soft magnetic material, including insulative material having electrical insulating properties and soft magnetic material. A ring-like secondary coil 12*r* is coaxially embedded in one end face of the secondary core 12. The one end face is formed into a flat coupling face for electromagnetic coupling with the primary core 11. A circular bole 12*b* formed in the central portion of the secondary core 12 has such a size as to permit an end portion 21*a* of the steering wheel shaft 21 to pass therethrough. The secondary core 12 is coaxially formed at its other end other end face with a ring-like groove 12*s* for positioning the secondary core 12.

With another end face of the secondary core 12, in which the secondary coil 12*r* is embedded, directed downward, the secondary core 12 is mounted to a lower face of the boss 31*b* using an adhesive. At this time, a claw 32*a* of the positioning jig 32 mounted to the outer peripheral face of the boss 31*b* is fitted into the groove 12*s*, thereby positioning the secondary core 12 with respect to the boss 31*b*. In this state, the adhesive is cured. Meanwhile, it is possible to directly mount the secondary core 12 to the lower face of the boss 31*b* with use of embedding bolts, which are adapted to be inserted into threaded holes formed in advance in the lower face of the boss 31*b*.

Thereafter, the positioning jig 32 is removed. An electric wire 12*e* pulled out from the secondary coil 12*r* of the secondary core 12 and an electric wire 31*e* pulled out from the air bag apparatus or the like incorporated in the steering wheel 31 are electrically connected to each other by using a connector apparatus 13. Since the electrical connecting operation (connection) can be done in an easy posture in the sub-assembly line, the operation efficiency can be improved. Since there is no substantial restriction in operation environment, moreover, it is possible to connect the electric wires 12*e* and 31*e* using a connecting method which is inexpensive and of high reliability such as ultrasonic welding, resistance welding, pressure welding, soldering or the like, instead of the electrical connecting operation using the connector apparatus 13.

The shaft module 20 and the steering wheel module 30 assembled in the sub-assembly lines (shaft module assembly line, steering wheel module assembly line) in the above-described manner are supplied to the main assembly line (vehicle body assembly line). In the main assembly line, the steering wheel module (secondary sub-module) 30 is mounted to the shaft module 20 already mounted on, e.g., a lower shaft ash of a vehicle body, while checking the rotary position of the shaft module 20.

More specifically, in mounting the steering wheel module 30 to the shaft module 20, the steering wheel module 30 is fitted on the shaft module 20 from above, while permitting an end portion 21*a* of the steering shaft 21 to pass therethrough, and serrations (not shown) formed in the end portion 21*a* are fitted into a mounting hole 31*c* of the boss 31*b* of the steering wheel 31 at an appropriate rotation angle. At that time, as shown in FIG. 1, a lower face of the boss 31*b* of the steering wheel 31 is brought to abut against the stepped portion 21*b* of the steering shaft 21, to thereby determine the mounting height of the steering wheel. By determining the mounting height of the steering wheel module 30 with respect to the shaft module 20 by the stepped portion 21*b*, it is possible to precisely determine a distance between the primary core 11 and the secondary core 12 opposed thereto, i.e., a distance (gap length g) between respective end faces (coupled faces) of the primary and secondary cores 11 and 12.

At that time, alignment jigs 41 each having a C-shaped cross section are fitted, from at least three directions, into the annular grooves 11*s* and 12*s* of the primary and secondary cores 11 and 12 from their upper and lower faces, whereby the primary core 11 and the secondary core 12 are coaxially positioned, as shown by way of example in FIG. 1. In this state, a nut 42 is threadedly engaged with the threaded groove 21*s* formed in the end portion 21*a* of the steering shaft 21, so that the steering wheel module 30 is rigidly mounted to the steering shaft 21, i.e., to the shaft module 20 integrally therewith. Thereafter, the alignment jigs 41 are removed, and the assembling operation of the steering module 40 is completed.

If the shaft module 20 and the steering wheel module 30 are assembled together in this manner, the primary core 11 and the secondary core 12, incorporated individually into the modules 20 and 30, are coaxially disposed such that they are opposed to each other at a predetermined distance (gap length g). That is, the primary core 11 and the secondary core 12 are mounted to the steering shaft 21 coaxially with each other with use of the grooves 11*s* and 12*s*, so that coaxial precision between the cores 11 and 12 is sufficiently ensured. Further, the mounting height of each of the cores 11 and 12 is determined by the flange 22*f* of the column shaft 22 and the stepped portion 21*b* of the steering shaft 21, and hence the distance between the cores 11 and 12 is determined with sufficient precision. As a result, even if the steering wheel 31 is rotated, the distance (gap length) between the opposed cores 11 and 12 is always kept constant, with the cores 11 and 12 kept opposed without causing deviation of their axes. Thus, the transmission characteristic of the rotary transformer 10 is sufficiently stably maintained. Therefore, even if the steering wheel assumes any rotary angle, it is possible to transmit electric power for initiating the inflation of the air bag apparatus from the primary core 11 to the secondary core 12 precisely and efficiently. Since the wiring operation related to the separable transformer 10 is already completed in the sub-module assembly step, it is unnecessary to newly carry out the wiring operation at the assembly step of the shaft module 20 and the steering wheel module 30.

In the case of producing and assembling step of automobiles, the air bag apparatus is mounted to the steering wheel module 30 after the steering wheel module 30 is fixed to the steering shaft 21 using the nut 42 as described above. To simplify the mounting operation of the steering wheel, it is conceivable that the steering wheel module 30 mounted with the air bag mechanism may be inserted into the steering shaft 21, and they may be fixed together with use of horizontal bolt and nut (not shown) corresponding to the nut 42. In such a case, if electrical wiring for the shaft module 20 and the steering wheel module 30 is carried out just after they are assembled together, the assemblage of the rotary transformer 10 and the fixing of the steering wheel to the steering shaft 21 can be made only by assembling the steering wheel module 30 using the horizontal bolt and nut. This facilitates the workability.

the separable transformer 10 incorporated in the steering wheel module 40 is not necessarily limited to one for initiating the inflation of the air bag apparatus, and can be used for contactless singnal transmission from the cruise control apparatus connected to the secondary core 12 and to the primary core 11.

The above-described separable-transformer assembling method can also be applied to a case where the primary and secondary cores constituting the separable transformer are disposed in a vehicle body module and a door module, respectively, so as to supply electric power for inflation to a side-air-bag apparatus accommodated in a door module, or electric power to a defroster hot wire of a door mirror, or electric power for driving a power-window motor. The separable-transformer assembling method can also be applied to a case where the primary and secondary cores of the separable transformer are respectively provided in an instrument panel module and a vehicle body module, so as to transmit control signals for, e.g., an air conditioner from an operating section of an instrument panel to a controller mounted to the vehicle, or supply driving electric power from the side of a vehicle body to an electrically-powered-seat driving motor mounted to a seat. In such cases, necessary electrical wiring for the primary and secondary cores 11, 12 can be carried out at the sub-module stage, so that the assembling workability can be improved.

[Second Embodiment]

Figure 4:
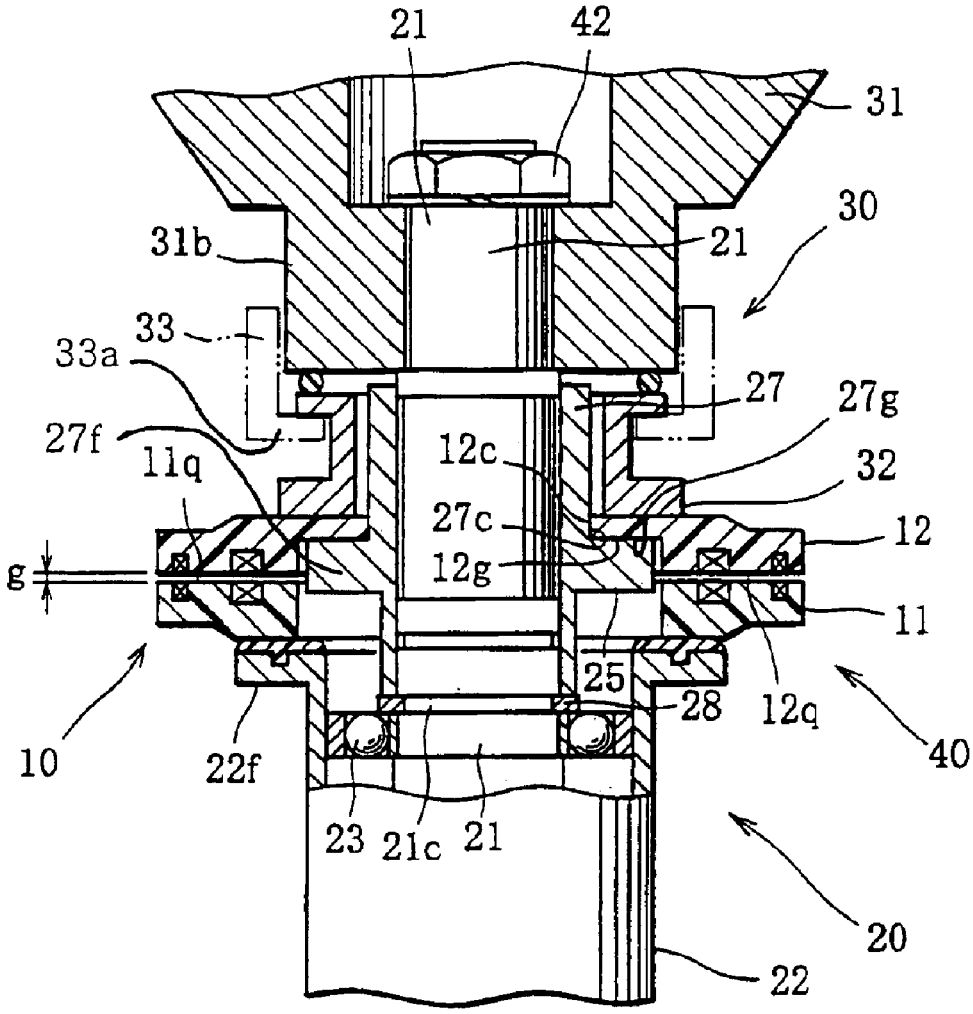
FIG. 4 is a sectional view showing an assembled state of a module including a rotary transformer according to a second embodiment of the invention.

To restrain a deviation of the rotation center of each of the stator core (primary core) 11 and the rotor core (secondary core) 12 within a predetermined range, and to restrain a deviation of the gap length g between the stator core 11 and the rotor core 12 within a predetermined range, thereby maintaining the transmission efficiency of the rotary transformer 10 at a constant level, it is possible to constitute the steering wheel module 40 by incorporating the steering wheel module 30 into the shaft module 20 so as to be rotatable, as shown by way of example in FIG. 4. A second embodiment shown in FIG. 4 is intended, in particular, to determine mounting positions of the stator core 11 and the rotor core 12 by using a guide positioning member 27 that is mounted to the steering shaft 21, thereby assembling the steering wheel module 40 in a state that the cores 11 and 12 are precisely positioned.

Figure 5:
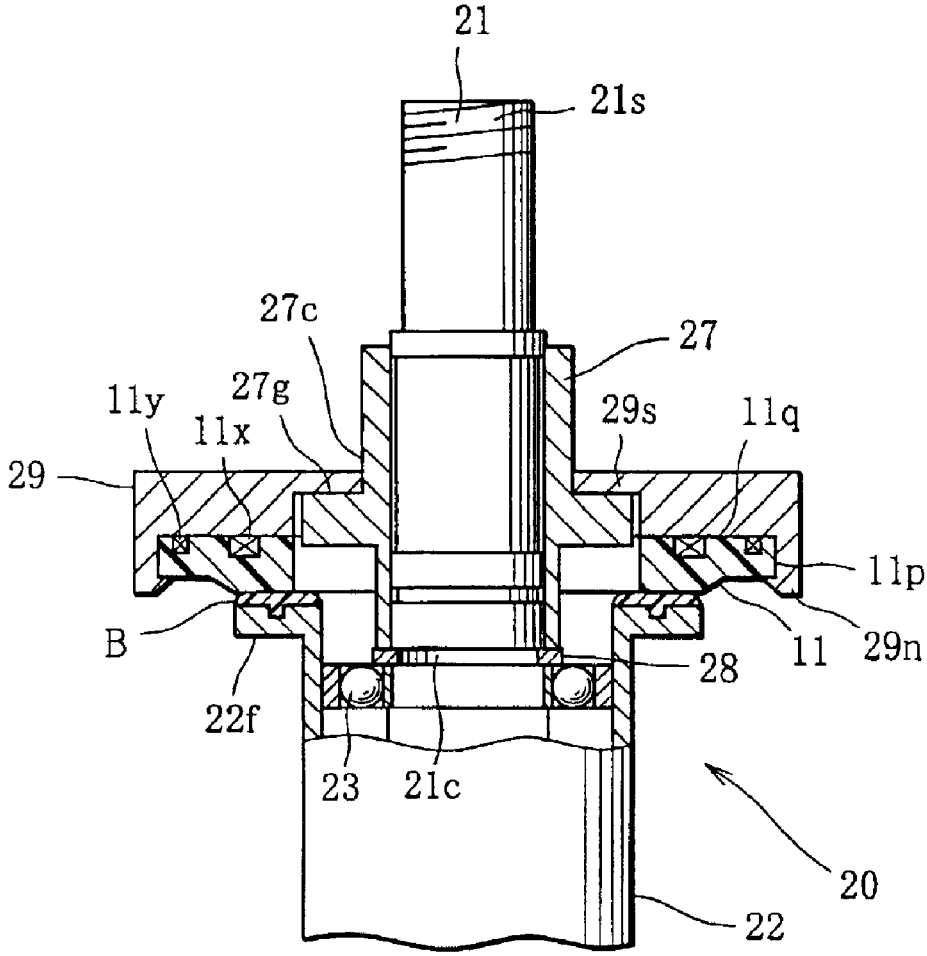
FIG. 5 is a sectional view for explaining a structure and an assembling procedure of a stator-side module shown in FIG. 4.

The second embodiment will be explained. The shaft module 20 incorporating therein the stator core (primary core) 11 comprises a steering shaft 21, a column shaft 22, the guide positioning member 27 and the like, as shown in FIG. 5.

More specifically, the steering shaft 21 coaxially and rotatably supported by the cylindrical column shaft 22 through a bearing mechanism 23 is formed such that a peripheral face of the steering shaft 21 has a high degree of roundness and the outer diameter of the steering shaft 21 is precise. The bearing mechanism 23 supporting the steering shaft 21 has a rotation face extending perpendicular to the rotation axis of the steering shaft 21, and the bearing mechanism 23 is formed with high precision such as to coaxially rotatably support the steering shaft 21 without inclination. Especially, the steering shaft 21 is configured to permit a snap ring 28 to be fitted into a groove 21*c* formed in a predetermined reference position on a peripheral face of a lower end portion of the steering shaft 21, with the snap ring 28 abutting against an upper face of the bearing mechanism 23. Thus, the steering shaft 21 is precisely supported at a predetermined vertical position relative to the bearing mechanism 23. The bearing mechanism 23 is precisely positioned and mounted to a predetermined position inside the column shaft 22.

The guide positioning member 27 fitted around the outer periphery of the steering shaft 21 is comprised of a cylindrical body having such an inner diameter as to permit the steering shaft 21 to be fitted therein with a predetermined dimensional tolerance. The cylindrical body is formed into a shape such that a ring-like flange 27*f* is provided at a central portion of its outer peripheral face. The guide positioning member 27 is fitted around a proximal portion of the steering shaft 21 so as to be mounted to the steering shaft 21 coaxially therewith, whereby it is precisely positioned and mounted to the bearing mechanism 23 through the snap ring 28 in a state that its lower end portion is abutted against an upper face of the snap ring 28.

In the guide positioning member 27, an upper face of the flange 27*f* serves as a gap reference face 27*g* for precisely determining a distance (gap length) between the stator core (primary core) 11 and the rotor core (secondary core) 12 opposed thereto, and a cylinder peripheral face of the flange 27*f* on the upper face side serves as a concentric reference face 27*c*, which is coaxial with the steering shaft 21, for coaxially positioning the stator core (primary core) 11 and the rotor core (secondary core) 12. By machining, with high precision, the guide positioning member 27 fabricated by injection molding or the like, the reference faces 27*g* and 27*c* are formed in advance into a flat face and a circumferential face which extend perpendicular to and coaxially with the axis of the guide positioning member 27, respectively, and which satisfy predetermined dimensional precision (tolerances) and face finishing precision so as to provide predetermined positioning precision. The outer diameter of the flange 27*f* is set smaller than the inner diameter of the stator core (primary core) 11 incorporated in the shaft module 20.

The stator core (primary core) 11 is substantially the same as that of the aforementioned embodiment. In the present embodiment, but a primary coil 11*x* for transmitting great electric energy for initiating inflation of an air bag apparatus and a primary coil 11*y* for transmitting control signal to a cruise control apparatus are disposed coaxially with each other.

To mount the primary core 11 including such primary coils 11*x* and 11*y* to the shaft module 20, a paste adhesive such as a two-part mixture type epoxy-base adhesive is first applied to the upper face of the flange 22*f* of the end portion of the column shaft 22. Then, the primary core 11 is fitted around the steering shaft 21 from above and placed on the upper face of the flange 22*f* to which the adhesive is applied. Thereafter, four block-like stator-core positioning jigs 29 supporting the primary core 11 from four directions, for example, are mounted to the outer peripheral face of the primary core 11 such that the positioning jigs 29 are brought in abutment against the guide positioning member 27, thereby determining the mounting position of the primary core 11 with high precision.

More specifically, the block-like stator-core positioning jigs 29 are each comprised of a rectangular parallelepiped block that has one side portion thereof provided with a claw 29*n*, adapted for core engagement, for holding the outer peripheral face of the primary core 11. These positioning jigs 29 are mounted in close contact with the upper face 11*q* and the outer peripheral face 11*p*of the primary core 11. The stator-core positioning jigs 29 each have another side portion thereof formed with a stepped portion 29*s* which abuts against the two reference faces 27*g* and 27*c* of the guide positioning member 27. The stator-core positioning jigs 29 are fabricated in advance with a high dimensional precision, as in the case of the guide positioning member 27, so that the positional relation between the stepped portion 29*s* and a holding face of the primary core 11 may be determined with high precision. The stator-core positioning jigs 29 are mounted in close contact with the upper face 11*q* and the outer peripheral face 11*p* of the primary core 11 in a state that the stepped portions 29*s* abut against the two reference faces 27*g* and 27*c* of the guide positioning member 27, thereby accurately determining the mounting position of the primary core 11 with reference to the reference faces 27*g* and 27*c*.

As a result, the primary core 11 placed on the upper face of the flange 22*f* is positioned with high precision in the diametrical and axial directions of the steering shaft 21 with reference to the reference faces 27*g* and 27*c* of the guide positioning member 27 through the stator-core positioning jigs 29. That is, the primary core 11 is disposed coaxially with the steering shaft 21 at a predetermined height relative to the upper face of the snap ring 28 (bearing mechanism 23) serving as a reference position. This state is kept until the adhesive is cured, whereby the primary core 11 is positioned and mounted on the flange 22*f* of the column shaft 22 with high precision. Thereafter, the stator-core positioning jigs 29 are removed, and the assembling operation of the primary core 11 to the shaft module 20 is completed. Then, electric wires 12*e* pulled out from the primary coils 11*x* and 11*y* are connected to the shaft module 20, as described above.

In the meantime, the primary core 11 may be placed on the upper face of the flange 22*f* while permitting the steering shaft 21 to be inserted therein, after a plurality of the stator-core positioning jigs 29 are mounted in advance to a peripheral face of the primary core 11. In such a case, the stepped portions 29*s* of the stator-core positioning jigs 29 may be fitted, along the reference face 27*g* of the guide positioning member 27, up to positions where they abut against the reference face 27*c*.

Figure 6:
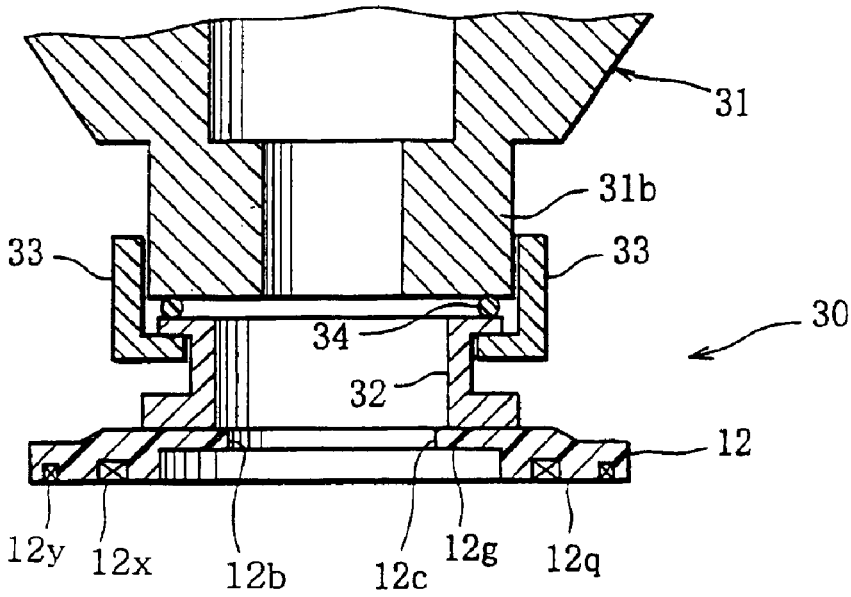
FIG. 6 is a sectional view for explaining a structure and an assembling procedure of a rotor-side module shown in FIG. 4.

On the other hand, the steering wheel module 30 has a structure such that the rotor core (secondary core) 12 is mounted to the boss 31*b* of the steering wheel 31 through the rotor-core fixing member 32 as shown by way of example in FIG. 6. The rotor core (secondary core) 12 is formed into a disk-like shape like the stator core (primary core) 11. In one side face of the rotor core 12, a secondary coil 12*x* for transmitting electric power for initiating inflation of the air bag apparatus and a secondary coil 12*y* for transmitting signal to the cruise control apparatus are coaxially disposed.

A through hole 12*b*, to which the concentric reference face 27*c* is fitted with a predetermined dimensional tolerance, is formed in a central portion of the secondary core 12. An inner peripheral face of the through hole 12*b* serves as a concentric reference face 12*c* which is coaxial with the secondary core 12. The concentric reference face 12*c*, abutting against the peripheral face (concentric reference face 27*c*) of the guide positioning member 27, serves to position the secondary core 12 coaxially with the guide positioning member 27 and the steering shaft 21. The central portion of that face of the secondary core 12 on which the secondary coils 12*x* and 12*y* are disposed is formed in to a recess having a predetermined depth. A bottom of the recess serves as a gap reference face 12*q* which extends in parallel to a coil disposing face 12*q*. The gap reference face 12*q*, abutting against the gap reference face 27*g* of the guide positioning member 27, serves to determine the mounting height of the secondary core 12 with use of the guide positioning member 27 as a reference. That is, the gap reference face 12*q* serves to position the coil disposing face 12*q* of the secondary core 12 at a predetermined height from that one side end face of the snap ring 28 which is the reference position in the longitudinal direction of the steering shaft 21.

The secondary core (rotor core) 12 having the above-described structure is mounted to a lower portion of the boss 31*b* of the steering wheel module 30 through the cylindrical rotor-core fixing member 32 having opposite ends thereof provided with flanges. The rotor-core fixing member 32, which includes a cylindrical portion of a diameter greater than that of the center hole 12*b* of the secondary core 12 through which the steering shaft 21 can be inserted, is fixed on the upper face of the secondary core 12 substantially coaxially therewith. The secondary core 12 and the lower flange of the rotor-core fixing member 32 are fixed together by means of adhesive or screw.

To mount the secondary core 12, fixed in advance at its upper face with the rotor-core fixing member 32, to the boss 31*b*, the upper-end side flange of the rotor-core fixing member 32 is disposed so as to be supported at its lower face by inwardly projecting lower ends 33*a* of the connection jigs 33, with use of L-shaped connection jigs 33 which are, e.g., four in number and mounted to the peripheral face of the boss 31*b* at equal distances as shown in FIG. 6. At that time, an O-ring 34 is interposed between an end face of the upper end side flange of the rotor-core fixing member 32 and the lower face of the boss 31*b*. Each of the connection jigs 33, supporting the rotor-core fixing member 32, serves to temporarily hold the rotor-core fixing member 32 on the lower face of the boss 31*b* so as to be moveable in the vertical and diametrical directions within a predetermined range. By holding the rotor-core fixing member 32 temporarily in this manner, the later-mentioned operation of mounting the steering wheel module 30 to the shaft module 20 is facilitated.

In such an assembled state, the electric wires 12*e* pulled out from the secondary coils 12*x* and 12*y* of secondary core 12 are electrically connected (connection) to the air bag apparatus (not shown) incorporated in the steering wheel 31, whereby the assembling operation of the steering wheel module (secondary sub-module) 30 is completed.

The steering wheel module (secondary sub-module) 30 is mounted to the shaft module 20 in the following manner. That is, the rotor-core fixing member 32 and the secondary core 12, formed with the through hole 12*b* and incorporated in the steering wheel module (secondary sub-module) 30 having the boss 31*b* formed with a mounting hole, are inserted from above the steering shaft 21 of the shaft module 20, as shown in FIG. 4. The steering wheel module 30 is fitted to the serrations formed around the end portion 21*a* of the steering shaft 21 at a predetermined rotation angle, and the nut 42 is lightly (loosely) threaded to a screw portion 21*s* formed at a tip end of the steering shaft 21.

At that time, the concentric reference face 12*c* of the secondary core (rotor core) 12 which is temporarily held by the connection jig 33 with a predetermined play is fitted, with predetermined tolerances, to the concentric reference face 27*c* which is the outer peripheral face of the guide positioning member 27, thereby positioning the secondary core 12 with respect to the steering shaft 21 coaxially. At the same time, the gap reference face 12*g* of the secondary core (rotor core) 12 is pressed against the gap reference face 27*g* which is the upper face of the flange 27*f* of the guide positioning member 27, thereby determining the mounting height of the secondary core 12. In this state, the nut 42 is rigidly threaded to the screw portion 21*s*, thereby completely fastening the boss 31*b* of the steering wheel 31 in the longitudinal direction of the steering shaft 21.

Thus, the secondary core 12 is sandwiched between the lower face of the boss 31*b* and the upper face of the flange 27*f* of the guide positioning member 27 through the rotor-core fixing member 32, and the fastening force of the nut 42 is transmitted to the secondary core 12 through the O-ring 34 and the fixing member 32, and the gap reference face 12*g* of the secondary core 12, so that the gap reference face 27*g* of the guide positioning member 27 and the gap reference face 12*g* of the secondary core 12 are reliably brought in abutment against each other. At that time, the O-ring 34 is deformed to absorb a positional deviation of the secondary core 12 which abuts against the guide positioning member 27 to determine its mounting position and a positional deviation of the boss 31*b* of the steering wheel 31 mounted to the steering shaft 21 using the nut 42. The mounting height position of the secondary core 12 is determined by the guide positioning member 27, and the secondary core 12 is coaxially mounted through the guide positioning member 27 to the steering shaft 21 at a predetermined height position measured from the reference position determined by the snap ring 28.

Thereafter, the connection jigs 33 are removed, and the assembling operation of the steering wheel module 40, performed by mounting the steering wheel module 30 to the shaft module 20, is completed.

According to this assembling method, the guide positioning member 27 is coaxially fitted to the steering shaft 21, using the bearing mechanism 23, incorporated in the column shaft 22 and pivotally supporting the steering shaft 21, as an axial reference position of the steering shaft 21. Utilizing the concentric reference face 27*c* and the gap reference face 27*g* formed on the guide positioning member 27 and using the stator-core positioning jig 29, the primary core (stator core) 11 is positioned and fixed to the end of the column shaft with high precision. Further, utilizing the concentric reference face 27*c* and the gap reference face 27*g* formed on the guide positioning member 27, the secondary core (rotor core) 12 is positioned and mounted with high precision to the guide positioning member 27. As a result, the primary core (rotor core) 11 and the secondary core (rotor core) 12 are positioned with reference to the common concentric reference face 27*c* and the gap reference face 27*g* of the guide positioning member 27. Therefore, the cores 11 and 12 are disposed in parallel so as to be opposed to each other at a predetermined distance in the direction perpendicularly to the axis of the steering shaft 21 and disposed coaxially with the steering shaft 21 without misalignment. Therefore, the opposed positional relation between the cores 11 and 12 is not varied by the rotation of the steering wheel 31 and hence the transmission efficiency of signal or energy between the cores 11 and 12 does not vary, making it possible to assemble the separable transformer (rotary transformer) 10 having stable performance.

The number of the stator-core positioning jigs 29 and the connection jigs 33 may not be four as in the above embodiment, and the provision of three or more jigs disposed in the circumferential direction will suffice. Further, instead of fixing the primary core (stator core) 12 to the end portion of the column shaft 22 using adhesive, the primary core 12 can be screwed to the column shaft 22 in a state that a spacer (not shown) having appropriate thickness is interposed between the end portion of the column shaft 22 and the primary core 12. More specifically, the primary core 12 can be fixed to the column shaft 22 using screws or the like in a state that the stator-core positioning jigs 29 are brought in engagement with the guide positioning member 27 and the primary core (stator core) 12 and the spacers having different thickness are interposed at predetermined positions between the stator core 12 and the flange 22*f* of the column shaft 22. The connection jigs 33 may be kept mounted to the boss 31*b*.

[Third Embodiment]

Figure 7:
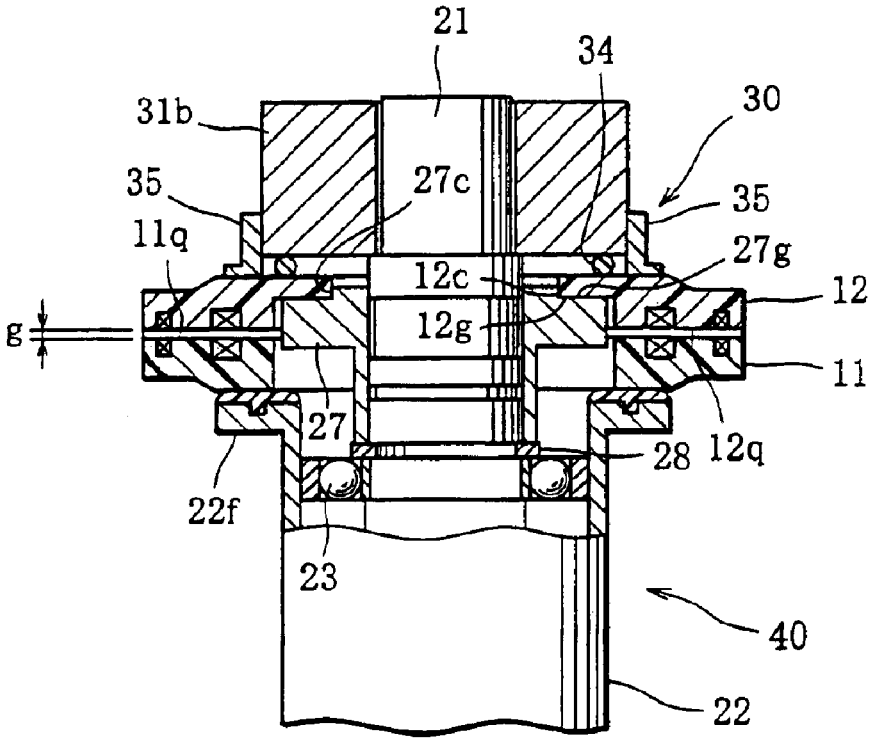
FIG. 7 is a sectional view, showing a third embodiment of the present invention, for explaining a structure and an assembling procedure of a steering module including a rotary transformer.
Figure 8:
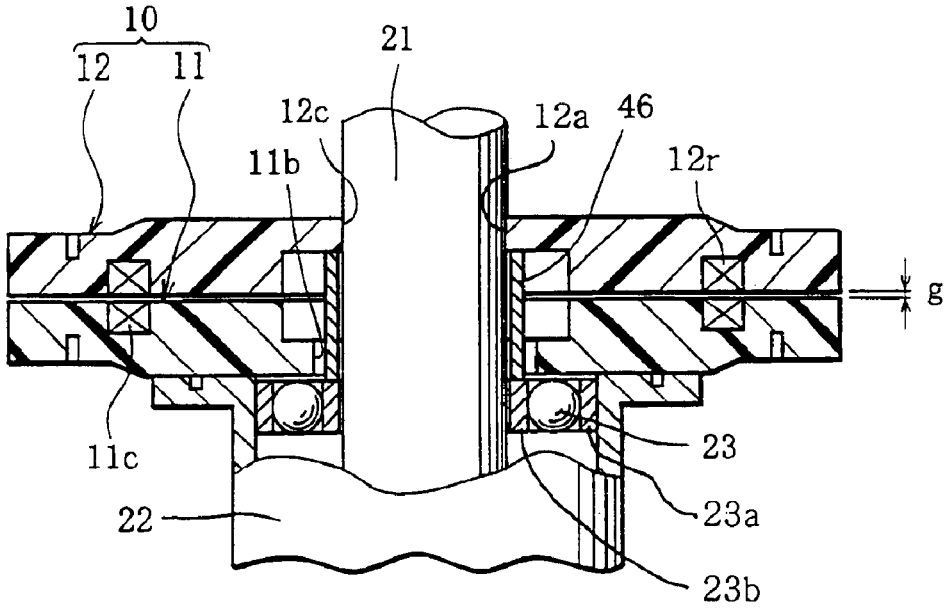
FIG. 8 is a sectional view, showing a fourth embodiment of the present invention, for explaining a structure and an assembling procedure of a steering module including a rotary transformer.

To mount the secondary core (rotor core) 12 to the boss 31*b*, connection members 35 may be used, which are temporarily held on the peripheral face of the boss 31 such that their axial positions can be adjusted as shown in FIG. 7. That is, the secondary core (rotor core) 12 is mounted to lower portions of the plurality of connection members 35 which are temporarily held on the peripheral face of the boss 31*b* of the steering wheel module 30 at equal distances circumferentially of the boss, the O-ring 34 is interposed between the secondary core (rotor core) 12 and the boss 31*b*, and the secondary core (rotor core) 12 is mounted to the boss 31*b* so as to be axially moveable. The steering shaft 21 is fabricated such as to have sufficiently high degree of roundness as in the foregoing embodiment. The bearing mechanism 23 supporting the steering shaft 21 is also fabricated with high precision such that it has the rotation face thereof extending perpendicularly to the rotation axis of the steering shaft 21, thereby rotatably coaxially supporting the steering shaft 21 without inclination. In this case, the guide positioning member 27 is formed shorter than that of the second embodiment.

In a positioning state that the secondary core (rotor core) 12 is brought into abutment against the guide positioning member 27, the boss 31*b* is fixed to the steering shaft 21 and the connection members 35 are rigidly fixed to the peripheral face of the boss 31*b*.

Even when the secondary core (rotor core) 12 is mounted to the steering wheel module 30 with use of the connection members 35 such that the core 12 can move in only the axial direction, the secondary core (rotor core) 12 is positioned coaxially with the steering shaft 21 with reference to the guide positioning member 27. As a result, even if the boss 31*b* of the steering wheel 31 mounted to the steering shaft 21 is deviated from the steering shaft 21, it is possible to keep a positional relation between the primary core (stator core) 11 and the secondary core (rotor core) 12 so as to maintain a state (positional relation) where these cores oppose in parallel to each other at a predetermined distance in the axial direction, irrespective of rotation of the steering shaft 21.

[Fourth Embodiment]

A fourth embodiment is intended to carry out the assembling operation in which the steering shaft 21, fabricated to have a sufficiently high degree of roundness, or the bearing mechanism 23, fabricated with high precision and rotatably supporting the steering shaft 21 or the like, is directly utilized as references (reference portions) for positioning the primary core (stator core) 11 and the secondary core (rotor core) 12. That is, the steering shaft 21 is fabricated to have the degree of roundness which is sufficiently high, and the bearing mechanism 23 supporting the steering shaft 21 is fabricated with high precision to have the rotation face extending perpendicularly to the rotation axis of the steering shaft 21 and so as to rotatably support the steering shaft 21 coaxially therewith without inclination.

In this embodiment, the bearing mechanism 23 provided between the steering shaft 21 and the column shaft 22 and rotatably supporting the steering shaft 21 serves as a reference portion for determining the mounting position of the primary core 11. With reference to an upper face of an outer race 23*a* of the bearing mechanism 23, the mounting height position of the primary core 11 is determined, and the primary core 11 is fixed to the column shaft 22. When the bearing mechanism 23 is provided at a portion recessed from the end portion of the column shaft 22, a ring-like spacer (not shown) having predetermined thickness may be mounted on the upper face of the outer race 23*a* of the bearing mechanism 23, so as to determine the mounting position of the primary core 11 through the spacer. The mounting position of the primary core 11 in the diametrical direction may be determined with reference to the peripheral face of the steering shaft 21 using a jig which is not shown.

On the other hand, the mounting position of the secondary core 12 is determined using, as the reference, an upper face of an inner race 23*b* of the bearing mechanism 23. More specifically, a spacer 46 having a predetermined length is mounted to the steering shaft 21, and the mounting height of the secondary core 12 is determined through the spacer 46. This spacer 46 is disposed between the secondary core 12 and the inner race 23*b* of the bearing mechanism 23 and mounted so as to rotate in unison with the secondary core 12. As the spacer 46, a sleeve, an oilless bush or the like is employed, which is capable of maintaining the dimension of the gap g and the perpendicularity to the rotation plane of the bearing mechanism 23 (the degree of parallelization to the steering shaft 21). The position of the secondary core 12 in the diametrical direction is determined with reference to the peripheral face of the steering shaft 21. In this case, a through hole 12*a* is formed in advance, with high precision, at the center of the secondary core 12 such that an inner diameter of the through hole 12*a* meets an outer diameter of the steering shaft 21.

If the mounting of the primary core 11 and the secondary core 12 is performed with reference to the steering shaft 21 and the bearing mechanism 23, the gap length g between the cores 11, 12 and the perpendicularity to the rotation plane of the bearing mechanism 23 (the degree of parallelization to the steering shaft 21) are maintained. Thus, the performance of the rotary transformer 10 can be stably maintained, so that predetermined coupling efficiency may be attained. Since the primary core 11 and the secondary core 12 are easily mounted to the column shaft 22 and the steering shaft 21 which are excellent in machining precision, in a state they are positioned with reference to the bearing mechanism 23 and the steering shaft 21, the mounting operation is simplified.

[Fifth Embodiment]

If the location of a positioning portion, serving as the reference for assembling the rotary transformer 10, is precisely determined in advance, part of a component other than the bearing mechanism 23 may be utilized as an auxiliary reference position in the mounting operation for the primary core 11 and the secondary core 12. As shown by way of example in FIG. 9, if the location of a bracket 47 mounted to the column shaft 22 is precisely determined in advance with respect to the steering shaft 21, the primary core 11 may be positioned with reference to the bracket 47.

Figure 9:
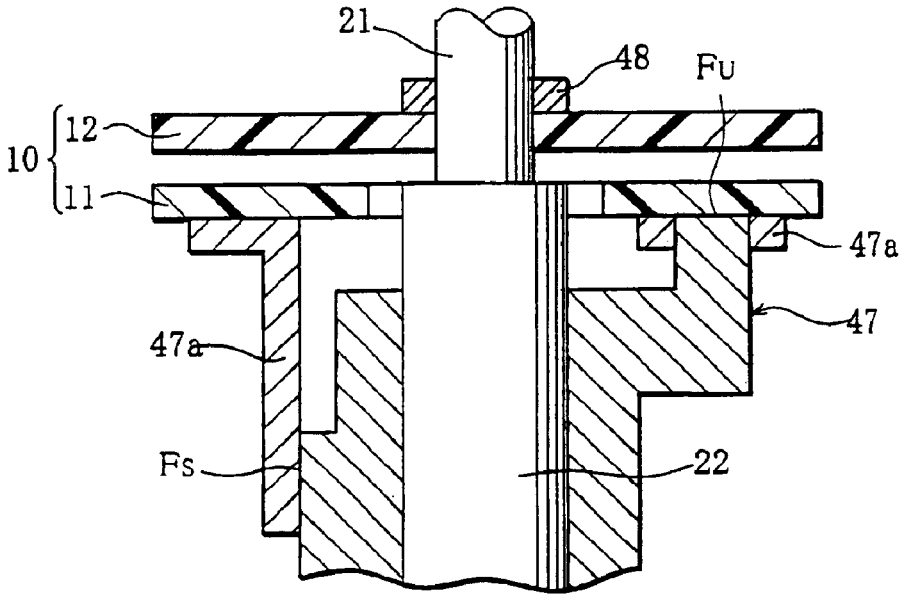
FIG. 9 is a sectional view, showing a fifth embodiment of the present invention, for explaining a structure and an assembling procedure of a steering module including a rotary transformer.

That is, if positions of an upper face FU and a side face FS of the bracket 47 mounted to the column shaft 22, as shown in FIG. 9, are accurately determined in advance with respect to the steering shaft 21, the primary core 12 may be mounted to the bracket 47 with reference to the faces FU and FS serving as the reference (auxiliary reference portions), using a desired guide plate 47*a* in combination therewith. In the case of the rotary transformer 10 incorporated in an automotive steering module, if the upper face FU and the side face FS of the bracket 47 are processed with positioning precision of ±0.5 mm, the mounting position of the primary core 11 is determined within error range of ±0.5 mm, so that sufficient effect can be expected.

To mount the secondary core 12 to the steering shaft 21, the mounting position may be determined by using the bracket 48 mounted to a predetermined position of the steering shaft 21. With this arrangement, by simply using the steering shaft 21 and the brackets 47 and 48 serving as positioning portions, the primary core 11 and the secondary core 12 may be mounted. Therefore, it is possible to make the assemblage with ease while enjoying sufficiently high assembling precision.

Although the mounting method of the rotary transformer to the automotive steering unit has been explained in the foregoing embodiments, the present invention can be used for contactless electrical connection between robot arms having the freedom of rotation.

INDUSTRIAL APPLICABILITY

According to the present invention, a primary sub-module and a secondary sub-module are assembled by carrying out desired electrical wiring after a primary core and a secondary core constituting a separable transformer are mounted individually to a primary-side unit and a secondary-side unit, and the separable transformer is assembled by combining these sub-modules. Therefore, the assemblage can be made efficiently with ease even when the transformer is mounted to an automotive steering mechanism. Further, electric wiring to coils of the modules can be easily carried out, and inexpensive connecting method such as crimp or welding can be used, if appropriate.

The primary core and the secondary core can easily and precisely be positioned, so that deviation of rotation center between the cores can be suppressed and the gap length can be maintained with high precision. Therefore, it is possible to sufficiently keep the transmission efficiency of the rotary transformer. Especially, the degrees of deviation and parallelization between the primary and secondary cores and the gap length can be maintained with high precision, to thereby easily realize a separable transformer having intended coupling efficiency.

What is claimed is:

1. A method of assembling a separable transformer onto an object, wherein said separable transformer comprises a primary core and a secondary core adapted to be opposed to each other and to effect contactless transmission of at least one of a signal arid energy therebetween, said method comprising:

mounting said primary core directly on a primary unit of the object adapted to be provided with the primary core and carrying out electric wiring, to thereby assemble a primary sub-module;

mounting said secondary core directly to a secondary unit of the object adapted to be provided with the secondary core and carrying out electric wiring, to thereby assemble a secondary sub-module; and assembling said primary sub-module including the primary core and said secondary sub-module including the secondary core together, with said primary and secondary cores opposed to each other;

wherein:

said primary core comprises a stator core mounted to a stationary member, and said secondary core comprises a rotor core mounted to a rotation shaft rotatably supported by said stationary member, said rotation shaft is provided with a guide member including a first reference face defining a reference position in a diametrical direction of the rotation shaft and a second reference face defining a reference position in an axial direction of the rotational shaft, and said stator core and said rotor core are respectively mounted to said stationary member and said rotation shaft with reference to said first and second reference faces of said guide member.

2. The method of assembling a separable transformer according to claim 1, wherein:

said stator core is positioned relative to said rotation shaft by a jig mounted to said guide member, and said stator core is mounted to said stationary member.

3. A method of assembling a separable transformer according to claim 1, wherein:

said rotor core is movably mounted to a rotary member and temporarily held by said rotation shaft, and said rotor core, abutting against said guide member, is positioned relative to said rotation shaft, and is then fixed in position to said rotation shaft and to said rotary member.

* * * * *

UNITED STATES PATENT AND TRADEMARK OFFICE

CERTIFICATE OF CORRECTION

PATENT NO. : 6,915,558 B2
DATED : July 12, 2005
INVENTOR(S) : Dongzhi Jin et al.

It is certified that error appears in the above-identified patent and that said Letters Patent is hereby corrected as shown below:

Title page,
Item [62], Related U.S. Application Data, after "Division of application No. 09/485,372" add -- which is a 371 of PCT/JP99/03103 06/10/1999 --.

Signed and Sealed this

Thirteenth Day of December, 2005

JON W. DUDAS
*Director of the United States Patent and Trademark Office*